United States Patent [19]

Becher

[11] 4,424,824

[45] Jan. 10, 1984

[54] GARDEN AND MARKET UMBRELLA

[75] Inventor: Klaus Becher, Dieringhausen, Fed. Rep. of Germany

[73] Assignee: Becher Textil- und Stahlbau GmbH, Dieringhausen, Fed. Rep. of Germany

[21] Appl. No.: 400,145

[22] Filed: Jul. 20, 1982

[51] Int. Cl.[3] ..... A45B 19/04

[52] U.S. Cl. ..... 135/20 M

[58] Field of Search ..... 135/20 R, 20 M, 98

[56] References Cited

U.S. PATENT DOCUMENTS

| | | | |
|---|---|---|---|
| 2,661,752 | 12/1953 | Kampf | 135/20 M |
| 3,311,119 | 3/1967 | Pearlstine | 135/20 M |
| 3,870,062 | 3/1975 | Medlin | 135/20 M |

FOREIGN PATENT DOCUMENTS

| | | | |
|---|---|---|---|
| 2353967 | 5/1974 | Fed. Rep. of Germany | 135/20 M |

*Primary Examiner*—Harland S. Skogquist

*Attorney, Agent, or Firm*—Diller, Ramik & Wight

[57] ABSTRACT

This disclosure relates to an umbrella having a support tube uppermost end portion into which is telescopically received an umbrella shaft carrying a crown to which is pivotally connected cover ribs, a sleeve in external telescopic relationship to the support tube, a plurality of struts pivotally connected between the sleeve and the cover ribs, a threaded spindle within the umbrella shaft threaded relative to a threaded nut fixed to the umbrella shaft, and a flexible element, such as a cable, rope or wire, having ends fixed to the sleeve and to the umbrella shaft and being guided over a pulley carried by the umbrella shaft.

6 Claims, 2 Drawing Figures

GARDEN AND MARKET UMBRELLA

Figure 1:
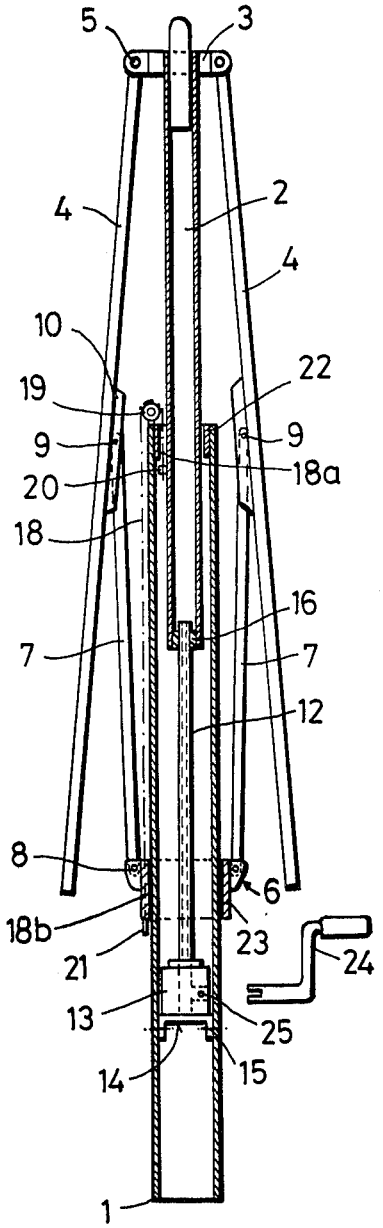

The present invention relates to a garden umbrella, a market umbrella or most any type of umbrella which includes a frame defined by a support tube into which is received an umbrella shaft carrying at its uppermost end a crown with cover ribs pivotally connected thereto and a slider or sleeve sliding on the support tube with support struts being interconnected between the sleeve and the cover ribs.

Conventional garden and/or market umbrellas of the latter-defined configuration vary to certain degrees, and garden umbrellas of the customary type generally have a relatively small span which permits the frame or cover to be opened manually by simply grasping a conventional slider and moving the same from a lower to an upper position. Closing the umbrella simply requires manually moving the slider or sleeve from an upper to a lower position.

There are also conventional garden umbrellas, market umbrellas and the like which are opened by means of a crank system. In the latter structures, a pinion is rotated by means of a crank handle that meshes with a rack which is in turn connected to the upper telescopic shaft portion of the umbrella.

There are also umbrellas in which the movements of the umbrella shaft and of the associated slider or sleeves are performed interdependently by control means of the type to which this invention is specifically directed, and very often a motor drive is required in the latter case.

It is a primary object of the present invention to provide in association with garden, market and like umbrellas a simple construction which, due to its operating system, can be easily opened and closed manually by means of a crank, and due to the system involved, the same may be utilized with umbrellas having spans or widths beyond the normal conventional dimensions of garden umbrellas.

The garden or market umbrella of the present invention is characterized in that an innermost end of a tubular umbrella shaft is internally threaded or carries an internally threaded nut which is threaded to an externally threaded spindle telescopically received in the tubular umbrella shaft and being fixed to the associated umbrella support tube with a flexible traction member being connected between the tubular umbrella shaft and a slider or sleeve externally surrounding an upper end portion of the support tube with the flexible traction member being entrained over a pulley.

The latter-defined combination allows the umbrella shaft to be slidably supported during its displacement in the support tube under very little opening and closing force while still carrying the cover ribs, struts and cover. Furthermore, during opening, the slider or sleeve is lifted forceably through the flexible traction member and due to the connection of the sleeve to the cover ribs through the struts, the cover ribs are urged to their open position simply through the opening force imparted to the umbrella shaft. The movements of the umbrella shaft and of the sleeve or slider are also in opposite senses or directions. In other words, to open the umbrella, the umbrella shaft is lowered by means of the associated threaded spindle while the slider or sleeve is lifted upwardly by the flexible traction member. In order to close the umbrella, the shaft is lifted while the slide or sleeve slides downwardly on the umbrella support tube. The slide, slider or sleeve slips downwardly under its own weight and by the proportionate weight of the support struts and the cover ribs. Thus, the manual operating system according to the invention is very well suited for garden and market umbrellas having a span width of between 4 to 6 meters in diameter, while 5 meters is a preferable width diameter. It is essential that a few parts will be sufficient, and the umbrella frame is designed as being as simple as possible so that the opening and closing can be readily performed manually.

In further accordance with this invention, another feature resides in the manner in which a lower end portion of the threaded spindle meshes with a miter gear supported nondisplaceably within the support tube. An upper end of the rotatable threaded spindle is provided with a threaded nut which is fixed to the umbrella shaft and as the miter gear is operated by a slip-in crank handle, its rotation is imparted to the threaded spindle which in turn is imparted to the umbrella shaft through the threaded nut.

The flexible traction member which connects the umbrella shaft to the slide or sleeve may be a wire rope, a cable, a chain or the like. One of its ends is fastened to the exterior of the umbrella shaft, while its other end is fixed to the displaceable sleeve or slider. Either or both connections can be achieved by inserting an end of the flexible traction member into a bore or a slot of the slider or an element connected to the umbrella shaft and fix the same in the bore or slot by a suitable locking element or member. The locking element or member can be, for example, a simple machine screw or bolt. This is a very simple matter of uniting the flexible traction member to the sleeve and the umbrella shaft.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a side elevational view with parts broken away in section, and illustrates the garden and/or market umbrella of this invention in its closed position, and illustrates a flexible traction member connected to a tubular umbrella shaft and to a sleeve in external sliding telescopic sliding relationship to an umbrella support.

Figure 2:
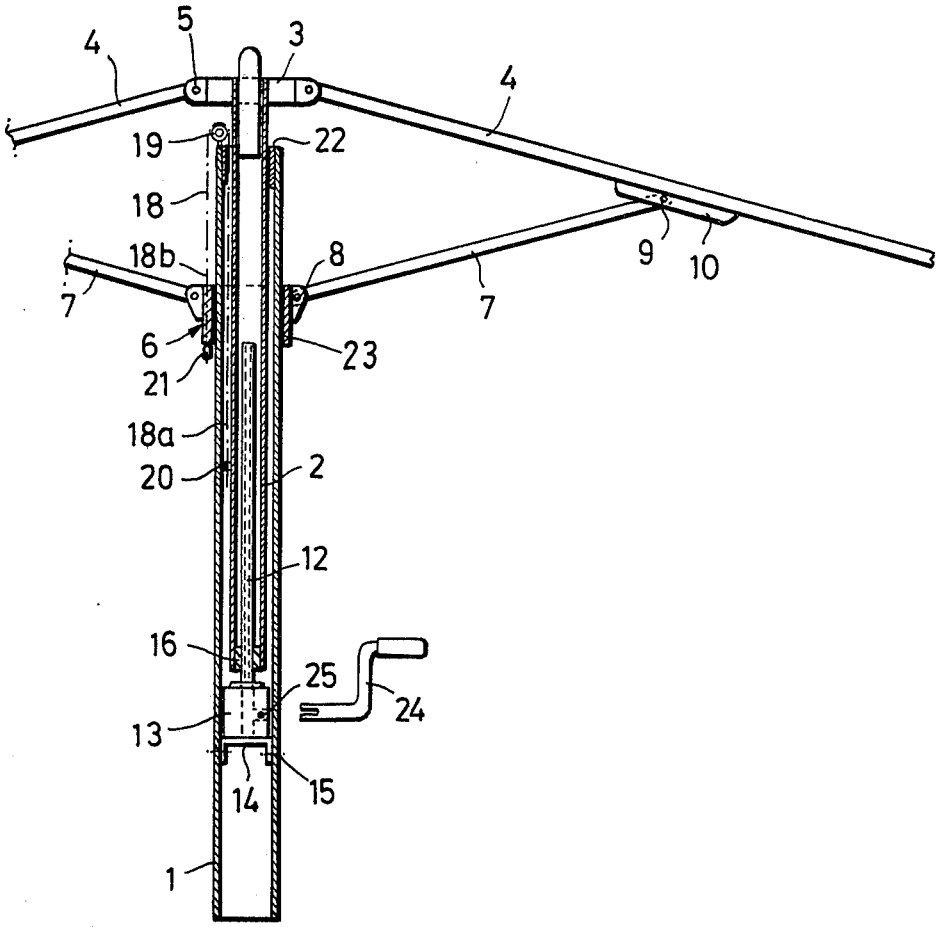

FIG. 2 is a view similar to FIG. 1, and illustrates the umbrella in its open position. A novel garden, market or like umbrella is illustrated in FIGS. 1 and 2 of the drawings in the respective opened and closed positions thereof and includes a support tube 1 which can be inserted into a stand or sleeve or the like (not shown) anchored in the ground. A tubular umbrella shaft 2 is provided to be telescopically displaceable longitudinally relative to the tubular support tube 1. The umbrella shaft 2 carries at an upper end or end portion thereof (unnumbered) a conventional crown 3 to which cover ribs 4 are pivotally connected at 5. Only one pair of cover ribs 4 is illustrated in the drawings, but it is to be understood that more than these are provided in the usual manner.

A slider 6 is in external telescopically sliding relationship to the support tube 1 and can be displaced vertically therealong between the opened and closed positions shown in FIGS. 2 and 1, respectively. Support struts 7 are connected to the sleeve, slide or slider 6 and to the cover ribs 4 at respective pivots 8 and 9. It is also possible to provide the cover ribs 4 with longitudinal reinforcements 10 at the pivots 9.

The overall operating system of the garden, market or like umbrella includes threaded means in the form of a threaded spindle 12 supported in an undisplaceable or fixed fashion at a lower end portion (unnumbered) by means of gear means in the form of a miter gear 13. It is preferable to use a buttress as a threaded spindle 12. The miter gear or gear means 13 is stationarily supported by a mounting or bracket 14 within the support tube 1, and the mounting or bracket 14 is fixed to the support tube 1 by fasteners 15. The miter gear 13 may be, for example, a worm and wheel gear of a conventional arrangement nonrotatably to the threaded spindle 12 so that rotation imparted to the miter gear 13 will in effect rotate the spindle 12. The spindle 12 is threaded into an internally threaded nut 16 which is fixed within the umbrella shaft 2.

The umbrella shaft 2 and the slide, sleeve or runner 6 are interconnected by flexible traction means in the form of a flexible traction member, element, cable, rope, wire or chain 18 which is guided via pulley means in the form of a pulley 19. The pulley 19 is secured in a conventional manner to an upper end portion (unnumbered) of the support tube 1. An end 18*a* of the traction member 18 is firmly secured to the umbrella shaft 2 by means of conventional fixing means 20, e.g., a screw or the like, while another end 18 via the traction member 18 is firmly connected to the slide or sleeve 6. The latter connection may be realized by conducting the end 18*b* of the traction member 18 through a bore or slot (unnumbered) of the sleeve 6, and the lower projecting end underengaging the sleeve 6 by means of a tightening screw 21 or the like.

A sleeve 22 is fixed internally of the support tube 1 to guide the umbrella shaft 2 as it moves telescopically into or out of the support tube 1. Moreover, the sleeve 6 is slidably supported relative to the support tube 1 by means of a sleeve 23 which may consist of plastics or like friction-reducing material. The corresponding longitudinal guides (not shown) ensure that the umbrella shaft 2 and the sleeve 6 are protected against torsion relative to the support tube 1. The miter gear 13 is actuated by means of a removal crank handle 24 that can be mounted or keyed to a pin 25 on a part of the miter gear 13.

The umbrella is opened by rotating the spindle 12 through the miter gear 13 through the crank handle 24. As a result, the threaded nut 16 moves along the spindle 12 in a downward direction to draw the umbrella shaft 2 into and downwardly relative to the support tube 1. At the same time, the slider or sleeve 6 slides up along the support tube 1 by means of the traction member 6, thus, supporting the spreading of the cover ribs 4 by means of the support struts 7.

FIG. 2 shows the umbrella of FIG. 1 in its open position with the crown 3 lowered to near the upper portion of the support tube 1, while the slider or sleeve 6 is forceably shifted upwardly. To close the umbrella, the threaded spindle 12 is rotated in an opposite direction by means of the crank handle 24, thus, shifting the umbrella shaft 2 in an upward direction while the sleeve 6 slides downwardly along support tube 1 under the action of the following weight of the components associated therewith. At the same time, the cover ribs 4 and the struts 7 are caused to take the position shown in FIG. 1. Due to the threaded spindle 12, a high-powered transmission is possible by applying very little force to the crank 24.

Although only a preferred embodiment of the invention has been specifically illustrated and described herein, it is to be understood that minor variations may be made in the apparatus without departing from the spirit and scope of the invention, as defined in the appended claims.

I claim:

1. An umbrella comprising a support tube having an uppermost end portion, an umbrella shaft being telescopically disposed in and reciprocally movable relative to said uppermost end portion, a plurality of cover ribs pivotally connected to said umbrella shaft, a sleeve in external telescopic sliding relationship to said support tube, a plurality of struts pivotally connected between said sleeve and associated ones of said cover ribs, control means for effecting interdependent relative movement of said umbrella shaft, support tube and slider during relative opening and closing of said umbrella through movement of said cover ribs and struts, said control means including means for imparting simultaneous movement to said umbrella shaft outwardly of said support tube and downward movement of said sleeve away from support tube uppermost end portion to move said umbrella from an open to a closed position, said control means being further operative for imparting simultaneous movement to said umbrella shaft inwardly of said support tube and upward movement of said sleeve towards said support tube uppermost end portion to move said umbrella from a closed to an open position, flexible means for connecting said sleeve to said umbrella shaft, said movement imparting means including a threaded spindle threaded to a threaded nut, said threaded spindle being disposed at least in part within said umbrella shaft, said threaded nut being fixed to said umbrella shaft, pulley means carried by said support tube upper end portion for guiding thereover said flexible means, said flexible means being an elongated flexible member having opposite ends, means for connecting one of said flexible member ends to said sleeve, means for connecting another of said flexible member end to said umbrella shaft, and said flexible member being the sole flexible member of said control means.

2. The umbrella as defined in claim 1 wherein said sleeve includes means for receiving an end portion of said flexible means, and means for locking said flexible means end portion in said receiving means.

3. The umbrella as defined in claim 1 wherein said sleeve includes means for receiving an end portion of said flexible means, means for locking said flexible means end portion in said receiving means, said receiving means being a bore in said sleeve, and said locking means being a fastener.

4. The umbrella as defined in claim 1 wherein said sleeve includes means for receiving an end portion of said flexible means, means for locking said flexible means end portion in said receiving means, said receiving means is a bore, and said locking means is a threaded fastener.

5. The umbrella as defined in claim 3 wherein said bore passes completely through said sleeve.

6. The umbrella as defined in claim 4 wherein said bore passes completely through said sleeve.

* * * * *